United States Patent [19]

Wolber

[11] Patent Number: 4,680,684

[45] Date of Patent: Jul. 14, 1987

[54] BED READING LAMP, PARTICULARLY FOR HOSPITAL BEDS

[75] Inventor: Wolfgang Wolber, Götzis, Austria

[73] Assignee: Zumtobel Aktiengesellschaft, Austria

[21] Appl. No.: 790,746

[22] Filed: Oct. 24, 1985

[30] Foreign Application Priority Data

Oct. 31, 1984 [AT] Austria ..... 3468/84

[51] Int. Cl.[4] ..... F21V 5/02

[52] U.S. Cl. ..... 362/223; 362/130; 362/309; 362/339; 362/332

[58] Field of Search ..... 362/308, 309, 147, 240, 362/241, 245, 244, 333, 326, 328, 329, 332, 339, 801, 217, 260, 74, 127, 130

[56] References Cited

U.S. PATENT DOCUMENTS

| | | | |
|---|---|---|---|
| 3,022,416 | 2/1962 | Roberts | 362/245 |
| 3,340,393 | 9/1967 | Franck et al. | 362/309 |
| 3,647,148 | 3/1972 | Wince | 362/223 |
| 4,071,750 | 11/1978 | Schneppendahl et al. | 362/339 |
| 4,450,509 | 5/1984 | Henry | 362/309 |

FOREIGN PATENT DOCUMENTS

| | | |
|---|---|---|
| 330291 | 7/1971 | Fed. Rep. of Germany . |
| 2630556 | 1/1978 | Fed. Rep. of Germany . |
| 955404 | 4/1964 | United Kingdom . |

*Primary Examiner*—Charles J. Myhre
*Assistant Examiner*—D. M. Cox
*Attorney, Agent, or Firm*—Toren, McGeady & Associates

[57] ABSTRACT

A bed reading lamp, particularly for hospital rooms, includes a lamp housing attachable to a wall of a room, the lamp housing including at least one cover which closes a light outlet opening provided in the lower area of the housing and which is translucent and serves to guide the light. The cover includes a lower first portion having an inclined part and a horizontal part and a second portion connected to the first portion. The inclined part and the second portion have prismatic profiles on their sides facing the lamp. The height of the prismatic profiles of the inclined part of the first portion decreases toward the horizontal part of the first portion. The cover provides a light distribution which ensures that neither the person lying in the bed provided with the lamp nor a person in a bed on an opposite wall will be blinded by the light of the lamp.

7 Claims, 5 Drawing Figures

BED READING LAMP, PARTICULARLY FOR HOSPITAL BEDS

The invention is directed to a bed reading lamp, particularly for hospital rooms comprising a lamp housing, which is preferably attachable to a wall of a room, comprising at least one tubular, elongate lamp and a reflector and at least one cover which closes a light outlet opening provided in the lower area of the housing and which is translucent and serves to guide the light and comprises a lower first portion and a front upright second portion connected to the latter.

The problem upon which this invention is based consists in providing a light distribution in such a lamp in such a way that the shade out angle is approximately 30° relative to the vertical line and approximately 7° relative to the horizontal line so that neither the person lying in the bed nor that person in the bed on the opposite wall will be blinded by the light the lamp. In order to meet this object the invention proposes that the first portion of the cover, which first portion is located under the lamp, comprises a part which is inclined at an angle $\alpha$ of approximately 6 to 10° relative to the horizontal line and which has a prismatic profile parallel to the axis of the lamp on its side facing the lamp and the second portion, which likewise has a prismatic profile at its inside, encloses an angle $\beta$ of approximately 40–50° relative to the horizontal line.

In order to illustrate the invention it will be described in more detail with the aid of an embodiment example shown in the drawing.

Figure 1:
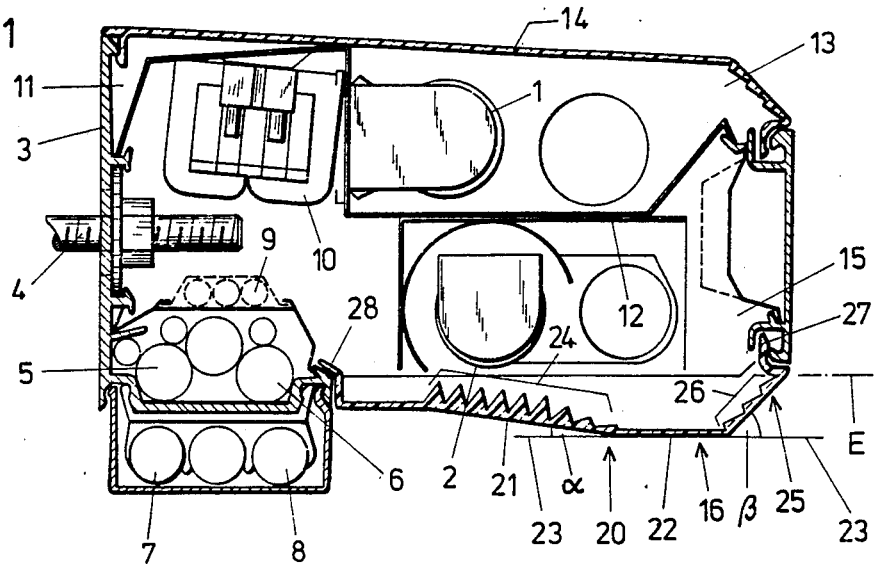
FIG. 1 shows a cross-section through a bed reading lamp.

FIG. 1 shows the cross-section of a lamp equipped with two tubular lamps 1 and 2 and comprising a housing 3 which is arranged by means of a fastening device 4 directly at a wall or at a power supply channel fastened at a wall. Various supply lines 5–9 are placed in the area of the housing 3 on the wall side. The devices 10 required for operation of the lamps 1 and 2 are accommodated in a chamber 11 of the housing 2 on the wall side. A substantially horizontally situated separating wall 12 divides the lamp housing 3 into a portion 13 which serves to illuminate the room and comprises a translucent cover 14 and the lamp 1 and into the actual bed reading lamp 15 with the lamp 2 and the cover 16.

Figure 3:
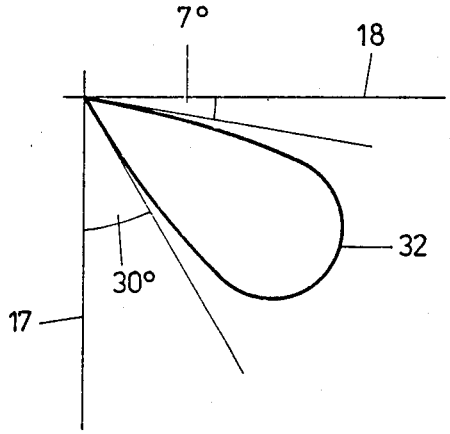
FIG. 3 shows the light distribution.

The light distribution expected of this bed reading lamp 15 is shown schematically in FIG. 3. The shade out angle relative to the vertical line 17 should be approximately 30° , the shade out angle relative to the horizontal line 18 should be approximately 7° so that neither the person lying in the bed nor the person across from him at the opposite wall of room is blinded by his reading light. In FIG. 3 the line 32 shows the extent of the light intensity in depedence on the respective angle between the vertical line 17 and the horizontal line 18.

Figure 2:
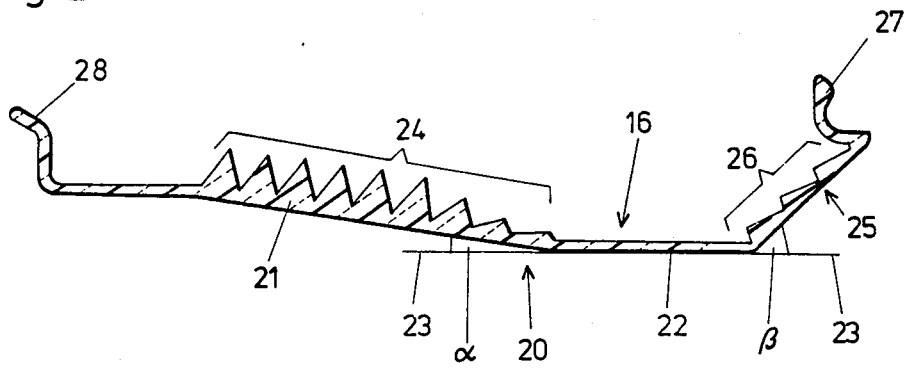
FIG. 2 shows a cross-section through the light guiding cover in enlarged scale relative to FIG. 1.

The cover 16, which is shown in FIG. 2 in an enlarged scale relative to FIG. 1, serves for this light distribution according to FIG. 3. The first portion 20, which is located beneath the lamp 2, is inclined at an angle $\alpha$ of approximately 6–10 ° relative to an imaginary horizontal plane 23. On its side facing the lamp 2 a prismatic profile 24 is provided which is parallel to the axis of this lamp. Connected to this inclined part 21 is a horizontally lying part 22 towards which the profile 24 ends, so to speak, so that its walls are smooth and this horizontally lying part 22 then passes into the second portion 25 which also carries a prismatic profile 26 at its inside which faces the lamp 2 and this portion 25 is inclined at an angle $\beta$ of approximately 40–50° relative to the repeatedly mentioned horizontal line 23. The section ledges 27 and 28 at the rim serve to fasten the cover 16 at the housing 3. From FIG. 1 it can also be seen that the actual light outlet plane E of the housing 3 and the cover 16, with its portions 20 and 25, do not coincide. The cover 16, with its profiles and its rim ledges 27 and 28, is manufactured in one piece from a translucent plastics material.

Figure 4:
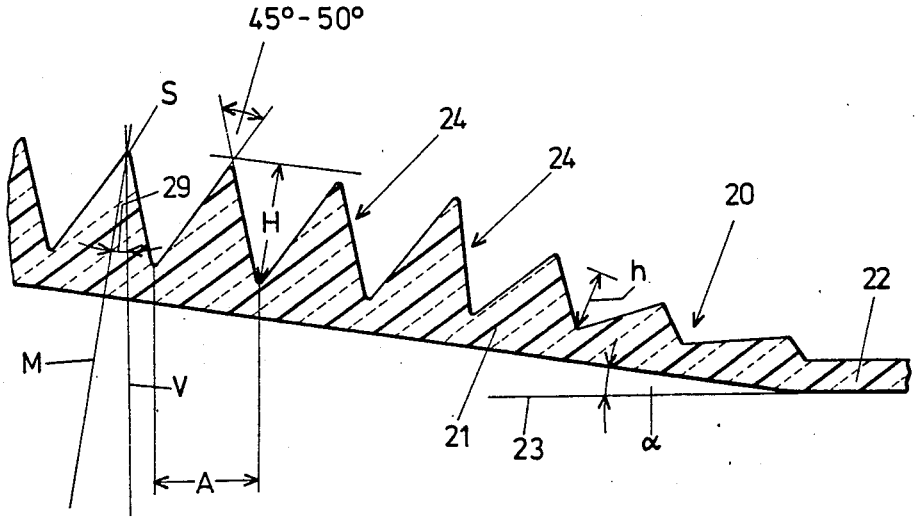
FIGS. 4 and 5 are details of various portions of the cover in an enlarged scale relative to FIG. 2.

FIG. 4 illustrates the prismatic profile 24 of the part 21 of the first portion 20 in a considerably enlarged scale relative to FIGS. 1 and 2. It can be seen from this that the aperture angle of the prismatic profiles 24 is approximately 45 to 50° and the center plane M which can be laid through the apex S is slanted with respect to an imaginary vertical plane V and that the angle of inclination 29 between these two planes is greater than the angle $\alpha$ of inclination of the part 21 of the first portion 20 relative to the horizontal line 23.

It can be seen in addition from this detail drawing according to FIG. 4 that the height of the prismatic profiles 24 decreases toward the horizontal part 22 of the first portion 21 of the cover 16 accompanied by simultaneous enlargement of the aperture angle, wherein this reduction is not linear. The quantity of the prismatic profiles 24 having a same height H is greater than the quantity of the profiles having a reduced height h, wherein the ratio of these profiles is aproximately 2:1. In the embodiment example shown a single prismatic profile 24 lies above the base width A (FIG. 4). In principle, it is possible to provide a plurality of such profiles above this base width A wherein these profiles are then to be reduced in the appropriate angle ratios without thereby influencing the light distribution in principle. Such a muliplication of the prismatic profiles, however, causes increased tool costs and an increased tool wear.

Figure 5:
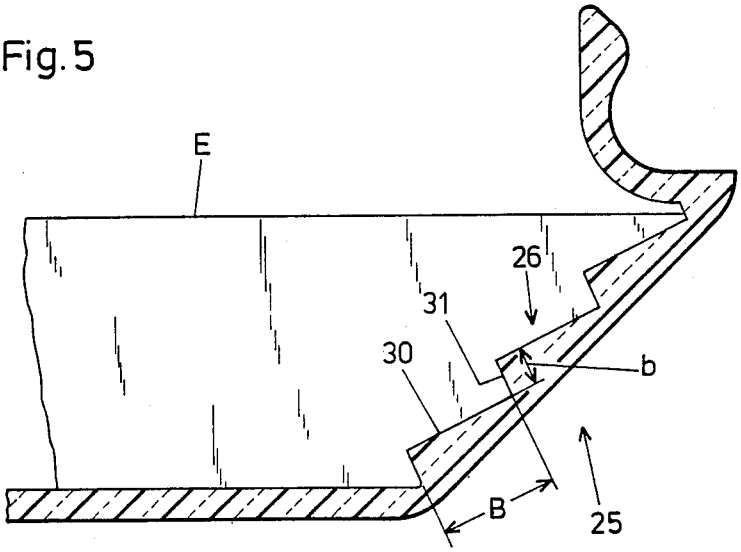

FIG. 5 shows the prismatic profile 26 in the second portion 25. Here, the aperture angle of the profile is approximately 90°. This profile 26 is arranged in such a way that the width B of the respective upper flank 30 is almost three times as great as the width B of the respective lower flank 31.

Also, with respect to this portion 25 a multiplication of the profiles 26 is conceivable as was already discussed in connection with the first portion 20. However, the disadvantages already mentioned with respect to the tool with which such a profile can be manufactured also apply here for such a multiplication.

It can be seen from FIG. 1 that all portions of the cover 16 having profiles 24 and 26, respectively, are located beneath the light source formed by means of the lamp 2. The axial direction of this lamp 2 is parallel to the longitudinal axis of the prismatic profiles. The lamp 2 is, moreover, arranged above the profile 24 of the inclined part 21 of the first portion 20 of the cover 16, namely preferably above the rear profile remote of the front inclined portion 25.

The invention was explained above by means of a bed reading lamp for hospital rooms which also has a second lamp 1 which serves for indirect room illumination. This lamp serving for room illumination is not substantial to the invention. The other construction of the bed reading lamp, as described above, particularly the arrangement of various supply lines 5–9, is also not substantial to the invention. The bed reading lamp can also be constructed differently. Although it was noted above that the bed reading lamp is arranged at a wall or at a supply channel fastened at a wall, this is also not compulsory for the invention. It would certainly be conceivable to arrange the bed reading lamp at a carrier connected directly with the bed frame.

I claim:

1. Bed reading lamp, particularly for hospital rooms, comprising a lamp housing, which is preferably attachable to a wall of a room comprising at least one tubular, elongate lamp and a reflector and at least one cover which closes a light outlet opening provided in the lower area of said housing and which is translucent and serves to guide the light and comprises a lower first portion and a front upright second portion connected to the latter, characterized in that said first portion (20) of said cover (16) located under said lamp (2) has a horizontal part (22) and a part (21) which is inclined downwardly toward said horizontal part (22)at an angle $\alpha$ of approximately 6° to 10° relative to said horizontal part (22) said inclined part (21) having a prismatic profile (24) parallel to the axis of said lamp (2) on its side facing said lamp (2) and said second portion (25) comprises a prismatic profile (26) at its inside and encloses an angle $\beta$ of approximately 40°–50° relative to said horizontal part (22), wherein the height (H) of said prismatic profiles (24) of said inclined part (21) decreases and said aperture angle increases toward the horizontal part (22) of said first portion (20).

2. Bed reading lamp according to claim 1, characterized in that the aperture angle of said prismatic profiles (24) at said first portion (20) is approximately 45°–55° and the center plane (M) extending through the apexes (S) of said prismatic profiles (24) is at a slant relative to an imaginary vertical plane (V) and the inclination angle between said two planes (M—V) is greater than the inclination angle $\alpha$ of said inclined part (21) of said first portion (20) relative to said horizontal part 22.

3. Bed reading lamp according to claim 1, characterized in that the quantity of said prismatic profiles (24) having a same height (H) relative to the quantity of said profiles having reduced height is approximately 2:1.

4. Bed reading lamp according to claim 1, characterized in that the aperture angle of said prismatic profiles (26) at said second portion (25) is approximately 90° and the width (B) of the respective upper flank (30) is approximately three times as great as the width (b) of the respective lower flank (31) of said prismatic profile (26).

5. Bed reading lamp according to claim 1, characterized in that said inclined portion (21) and said second portion (25) of said cover (16) which have said profiles (24,26) are located beneath said lamp (2) forming the light source.

6. Bed reading lamp according to claim 5, characterized in that said lamp (2) vertically lies above said profile (24) of said inclined part (21) of said first portion.

7. Bed reading lamp according to claim 1, characterized in that said horizontal part (22) is non-profiled.

* * * * *